US008051910B2

(12) United States Patent
Augustine

(10) Patent No.: US 8,051,910 B2
(45) Date of Patent: Nov. 8, 2011

(54) METHODS OF INFERRING FLOW IN A WELLBORE

(75) Inventor: Jody R. Augustine, League City, TX (US)

(73) Assignee: Baker Hughes Incorporated, Houston, TX (US)

( * ) Notice: Subject to any disclaimer, the term of this patent is extended or adjusted under 35 U.S.C. 154(b) by 525 days.

(21) Appl. No.: 12/107,304

(22) Filed: Apr. 22, 2008

(65) Prior Publication Data

US 2009/0260805 A1 Oct. 22, 2009

(51) Int. Cl.
*E21B 43/04* (2006.01)
*E21B 47/06* (2006.01)

(52) U.S. Cl. ..... 166/250.02; 166/51; 73/152.51

(58) Field of Classification Search ..... 166/250.01, 166/250.02, 227, 51, 66, 337; 73/152.51, 73/152.18, 152.52
See application file for complete search history.

(56) References Cited

U.S. PATENT DOCUMENTS

| | | | | |
|---|---|---|---|---|
| 6,554,064 | B1 * | 4/2003 | Restarick et al. | 166/250.01 |
| 6,832,158 | B2 * | 12/2004 | Mese et al. | 702/9 |
| 6,860,325 | B2 * | 3/2005 | Ramakrishnan et al. | 166/66 |
| 6,983,796 | B2 * | 1/2006 | Bayne et al. | 166/278 |
| 6,993,963 | B1 * | 2/2006 | Gudmundsson | 73/152.52 |
| 7,191,842 | B2 | 3/2007 | Hackworth et al. | |
| 7,565,834 | B2 * | 7/2009 | Adnan et al. | 73/152.12 |
| 7,735,555 | B2 * | 6/2010 | Patel et al. | 166/278 |
| 2008/0041594 | A1 * | 2/2008 | Boles et al. | 166/305.1 |
| 2008/0134775 | A1 * | 6/2008 | Pipchuk et al. | 73/152.18 |
| 2008/0210426 | A1 * | 9/2008 | Lembcke et al. | 166/302 |
| 2009/0283261 | A1 * | 11/2009 | Poitzsch et al. | 166/250.02 |
| 2010/0236643 | A1 * | 9/2010 | Brodeur et al. | 137/487.5 |

OTHER PUBLICATIONS

Hackworth, et al. "Development and First Application of Bistable Expandable Sand Screen," Society of Petroleum Engineers Annual Technical Conference and Exhibition held in Denver, CO, SPE 84265, Oct. 5-8, 2003.

* cited by examiner

*Primary Examiner* — Daniel P Stephenson
(74) *Attorney, Agent, or Firm* — Cantor Colburn LLP

(57) ABSTRACT

A method of inferring flow in a production string includes, monitoring pressure along a perforated production string, and inferring flow from the monitored pressure.

17 Claims, 6 Drawing Sheets

METHODS OF INFERRING FLOW IN A WELLBORE

BACKGROUND OF THE INVENTION

The subject matter disclosed herein relates to maintaining efficiency during the recovery of hydrocarbons from wellbores in earth formations. Efficient hydrocarbon recovery can be detrimentally affected by voids in gravel packs and collapses in open boreholes. Voids and collapses cause variations in flow rates, resulting in locally high flow rates that can erode sections of perforated production completion components, for example. Additionally, such locally high flow rates can cause debris to swirl and impinge upon walls of the production string and the borehole causing erosion and other damage thereto. Detecting and locating voids and collapses can allow an operator to alter production strategies to prevent such damage and is therefore desirable.

BRIEF DESCRIPTION OF THE INVENTION

Disclosed herein is a method of inferring flow in a production string. The method includes, monitoring pressure along a perforated production string, and inferring flow from the monitored pressure.

Further disclosed herein is a method of predicting a void in a gravel pack or a collapse in a borehole. The method includes, monitoring pressure along a perforated production string within the borehole, inferring flow from pressure detected in the monitoring, and predicting formation of the void in the gravel pack or the collapse in the borehole based upon matching of the pressure monitoring with pressure monitored in a borehole that preceded formation of a void in a gravel pack or a collapse in a borehole of another well.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Figure 1A:
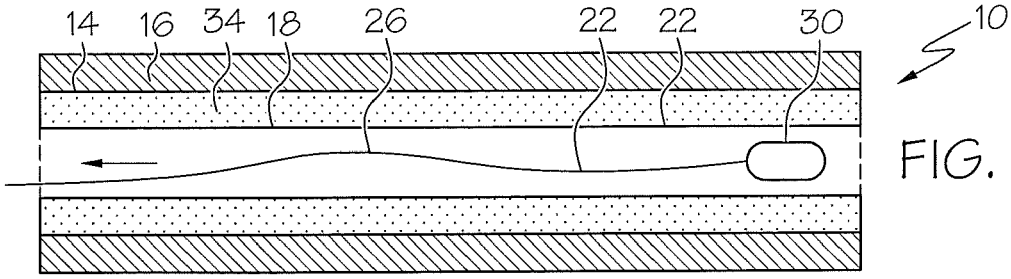
FIGS. 1A-1D depict partial cross sectional views through a screened well completion having variations in gravel packing and formation permeations.

Referring to FIG. 1A, a well completion 10 is illustrated within a borehole 14 in a formation 16. The well completion 10 includes, a perforated production string 18, shown herein as a screen, having distributed pressure sensors 22 along a length of the perforated production string 18. The distributed pressure sensors 22 can be integrated into the perforated production string 18 either outside or inside of the string 18, with fiber optic cable, for example. Alternately, the distributed pressure sensors 22 can be positioned along a wireline 26 that can be run downhole with a sinker 30. Additionally, alternate distributed pressure sensors 22 can be deployed in alternate embodiments while remaining within the scope of the present invention. The well completion 10 has a gravel pack 34 that is shown as 100 percent full.

Figure 1B:
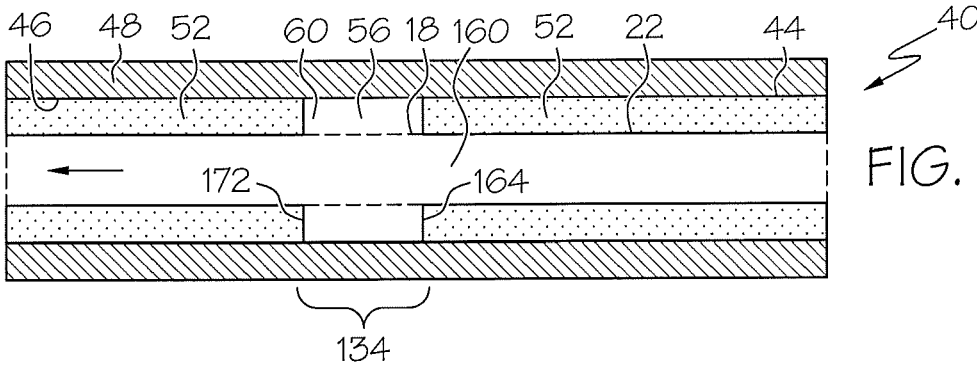

Referring to FIG. 1B, a well completion 40 is illustrated within a borehole 44, having a wall 46, in a formation 48. Unlike the completion 10, a gravel pack 52 of the completion 40 is not 100 percent fully packed but instead includes a void 56 in the annulus 60 between the perforated production string 18 and the borehole wall 46.

Figure 1C:
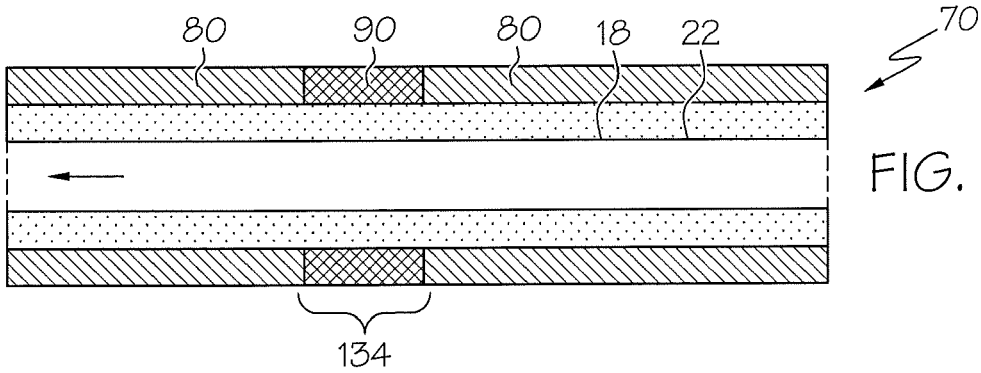
Figure 1D:
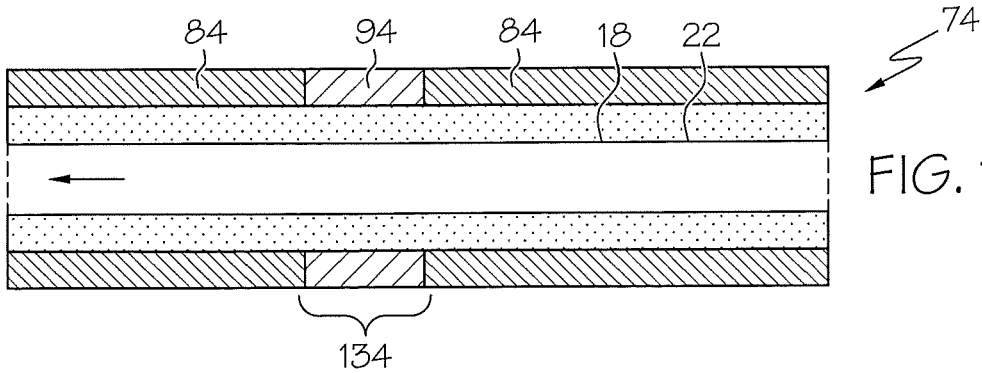

FIGS. 1C and 1D illustrate well completions 70 and 74, which are fully gravel packed. Each of the completions 70 and 74, however, has a formation 80 and 84 that has region 90 and 94, respectively, with a deviant hydrocarbon permeation rate. The permeation rate of the region 90 is higher than a balance of the formation 80, surrounding the region 90, and the permeation rate of the region 94 is less than a balance of the formation 84, surrounding the region 94.

Figure 2A:
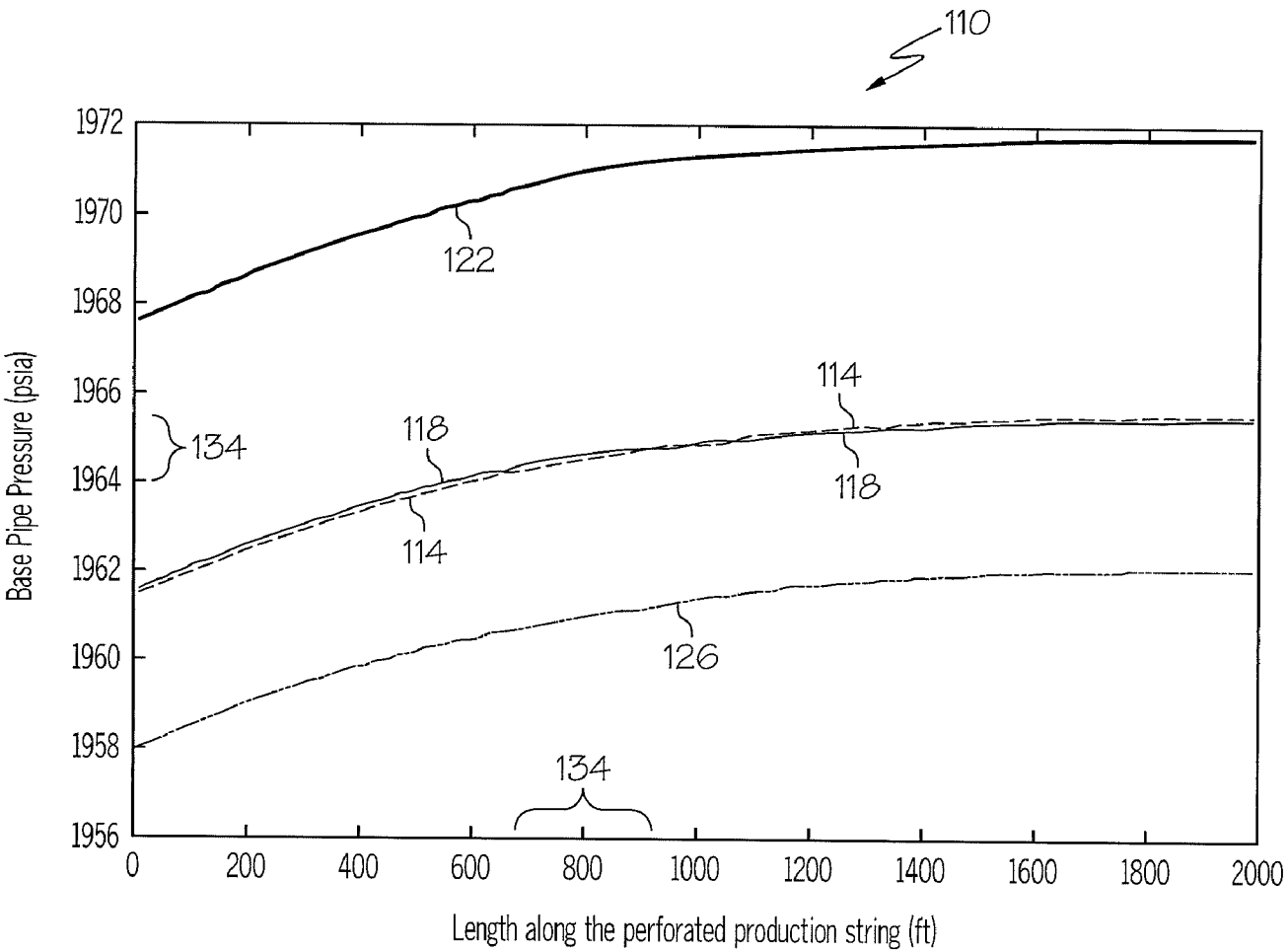
FIG. 2A depict a graph of pressure versus length along the perforated production strings of FIGS. 1A-1D.
Figure 2B:
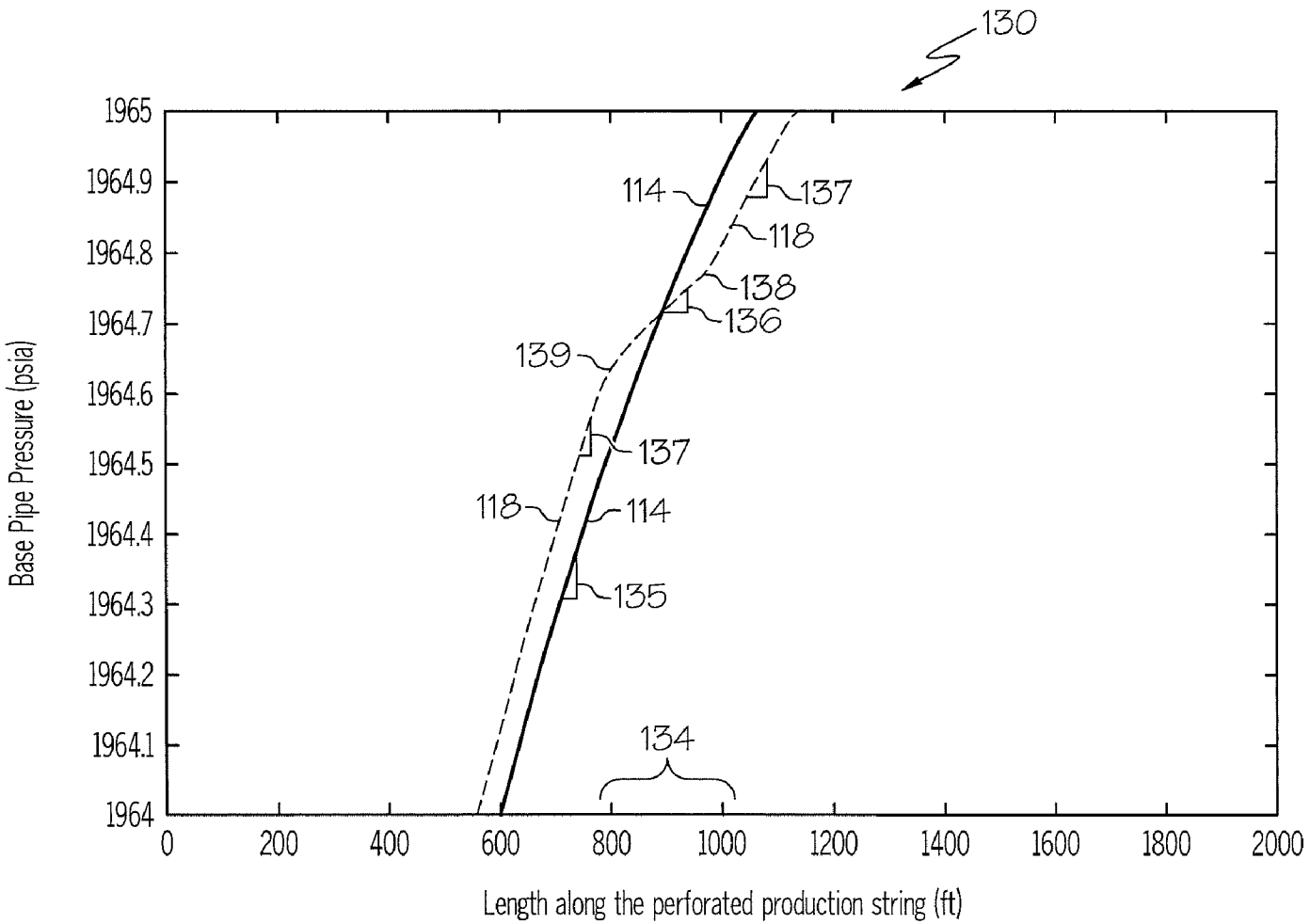
FIG. 2B depicts the graph of FIG. 2A with a portion of the pressure axis magnified.

Referring to FIG. 2A, a graph 110 of pressure versus length along the perforated production string 18 is illustrated for each of the completions 10, 40, 70 and 74. Specifically, curve 114 represents the pressure distribution for completion 10, curve 118 the pressure distribution for completion 40, curve 122 the pressure distribution for completion 70, and curve 126 the pressure distribution for completion 74. The scaling of the pressure axis in the graph 110 makes it difficult to discern a difference between the curves 114 and 118. Graph 130 of FIG. 2B has, therefore, been included, which magnifies the pressure axis in an area that corresponds to a region 134 that includes the void 56 of the graph 110. In graph 130, it can be observed that the curve 114 is smooth and has a slowly changing gradient 135 as a rate in change of pressure changes slowly over the length of the perforated production string 18 as would be expected since the completion 10 has no local disturbance that would account for a local change in the gradient 135. The void 56, however, in the region 134 of the curve 118 does have a different gradient 136 that is different than a gradient 137 in areas of the curve 118 outside of the region 134. As such, the curve 118 actually crosses over the curve 114 in the region 134. Changes in flow rates can be inferred from changes in pressure according to Bernoulli's Principle. Changes in flow rates associated with the void 56 will be described below.

Figure 3:
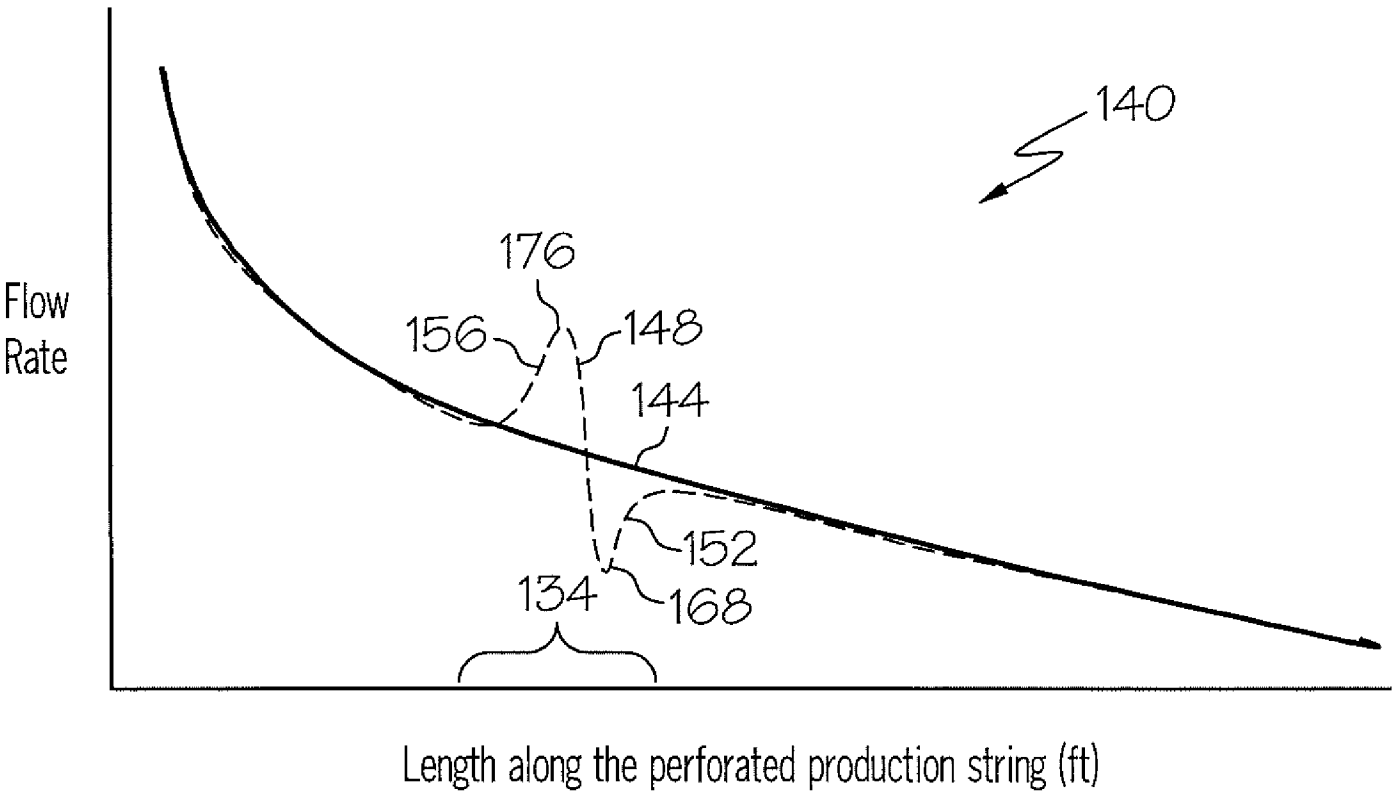
FIG. 3 depicts a graph of flow rate versus length along the perforated production strings of FIGS. 1A and 1B.

Referring to FIG. 3, a graph 140 of flow rate versus length along the perforated production string 18 is illustrated. A flow curve 144 is inferred from the pressure curve 114, while a flow curve 148 is inferred from the pressure curve 118. The flow curve 144 is smooth and continuous, since it is inferred by the smooth and the relatively slowly changing gradient 135 of the pressure curve 114. The pressure curve 114 reveals that the pressure is greatest at the deepest locations of the well and gradually lessens towards locations closer to the surface. In contrast, the flow curve 148 is not smooth since it is inferred from the curve 118 that has sharp transitions 138 and 139 between the gradients 137 and the gradient 135. Consequently, the flow curve 148 includes sharp deviations 152 and 156 in the region 134 due to effects that the void 56 has on flow and pressure as fluid flows therethrough. Below the region 134 and above the region 134, the curve 148 closely follows the curve 144 such that gradients 137 are similar to the gradient 135.

The transition 138 marks a beginning of the void 56 (i.e. the beginning of the region 134), moving in an uphole direction. The transition 138 coincides with an increase in an effective cross-sectional area 160 (FIG. 1B) of flow inside of the perforated production string 18 defined by the presence of the void 56. The perforated production string 18 has little resistance to flow and as such, fluid is free to flow out through the perforated production string 18, into the void 56, and back in again through the perforated production string 18. As such, at a downhole end 164 of the void 56, a local increase in the cross sectional area 160 (due to the void 56) causes a value of the gradient 136 to be less (less of a pressure decrease in the curve 118 per unit of length) than a value of the gradients 137. This change in the value of the gradients 137, 135 causes a corresponding flow rate drop 168 according to Bernoulli's Principle. The size of an increase in the cross sectional area 160 due to the void 56 can also be inferred from the flow rate drop 168. The flow rate drop 168, however, is reversed through a flow rate increase 176 as the cross sectional area 160 decreases as the flow reaches an uphole end 172 (FIG. 1B) of the void 56. The reduction in the cross-sectional area 160 results in a gradient of the pressure curve 118 returning to the gradient 137 from the gradient 135 at the transition 139.

In addition to detecting that the void 56 has formed, embodiments disclosed herein also allow an operator to locate the void 56 through analysis of the data gathered. Specifically, the downhole end 164 and the uphole end 172 of the void 56 correlate with the transitions 138 and 139 respectively, of the region 134. The graph 130 reveals that the transition 138 occurs at about 975 feet along the length of the perforated production string and the transition 139 occurs at about 775 feet. This information can, therefore, be used to quantify the size of a void since the uphole end 172 and the downhole end 164 are known.

Knowledge that a void 56 is present and further a location of the void 56, disclosed herein, can allow a well operator to plan around potential issues that could result from having the void 56. Such potential damage includes; erosion of the screen 18 due to the high flow rate 176 experienced as fluid reenters the screen 18 at the uphole end 172 of the void 56, and damage to the screen 18 or the borehole wall 46 due to contamination and gravel swirling within the void 56 at high production flow rates, for example.

Alternate embodiments can benefit an operator of a well completion that does not include a gravel pack. In such completions, an area outside of a screen is susceptible to formation collapse, which can be detrimental to well production. Formation collapses typically leave one or more annular voids outside of the screen. Embodiments of the present invention can detect and locate the annular voids in the collapse per the methods described above. Embodiments can also detect a collapse without voids, since the presence of a collapse will decrease the effective flow area of the open borehole and an end of the collapse will allow the effective flow area to return to the size of the open hole. Such information can provide valuable feedback to the well operator that can be helpful in formulating strategy regarding continuing production. Additionally, matching pressure data with pressure data that preceded a previous collapse, may allow an operator to predict that a collapse is pending, if well operations go unaltered. With this knowledge, an operator may pursue evasive actions to prevent the collapse from occurring. Direct monitoring of the pressure curves 114, 118, 122, 126 for deviations in slope, however, can be difficult since, as described, detrimental pressure gradient changes can be small.

Figure 4:
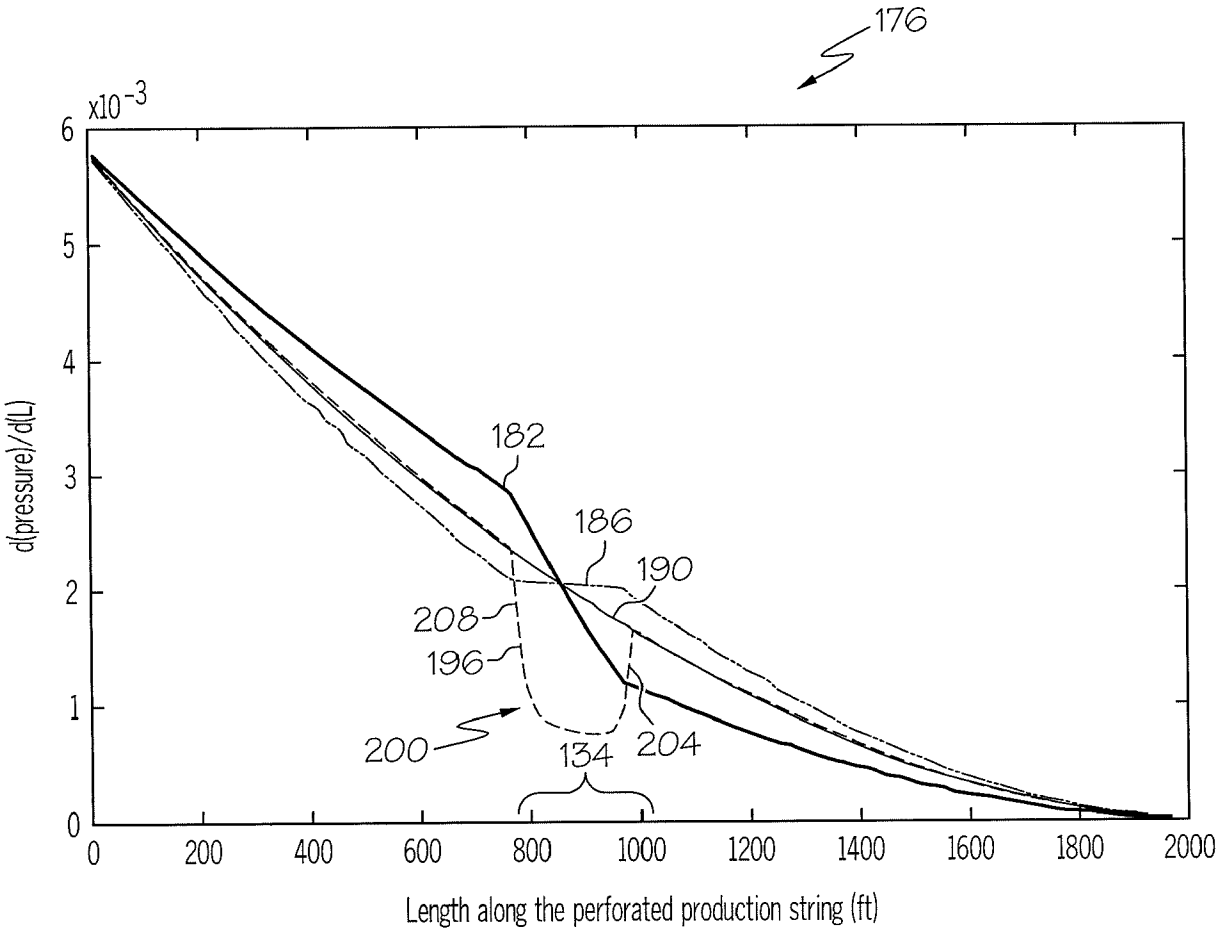
FIG. 4 depicts a graph of the first derivative of the graph of FIG. 2A.

Referring to FIG. 4, a graph 176, of the derivative of the graph 110, makes the deviations in gradient of the pressure curves 114, 118, 122, 126 easier to detect. For example, curve 182, which is a derivative of the curve 122, shows a change in gradient in the region 134 that may have gone undetected on the curve 122. Similarly, the curve 186, which is derivative of the curve 186, shows a gradient change in the region 134 that may also have gone undetected on the curve 126. Curve 190 is a derivative of the curve 114 and does not exhibit a change in gradient, as there is no local disturbance along the borehole wall 14. Curve 196, however, which is a derivative of the curve 118, shows a significant deviation 200 in the region 134. Specifically, the deviation has a first end 204 and a second end 208 that correlate with the transitions 138 and 139 respectively. The ends 204, 208 of the deviation 200 simplify the locating of the void ends 164, 172 on the curve 118. This locating can be improved even further by taking a second derivative of the curve 118.

Figure 5:
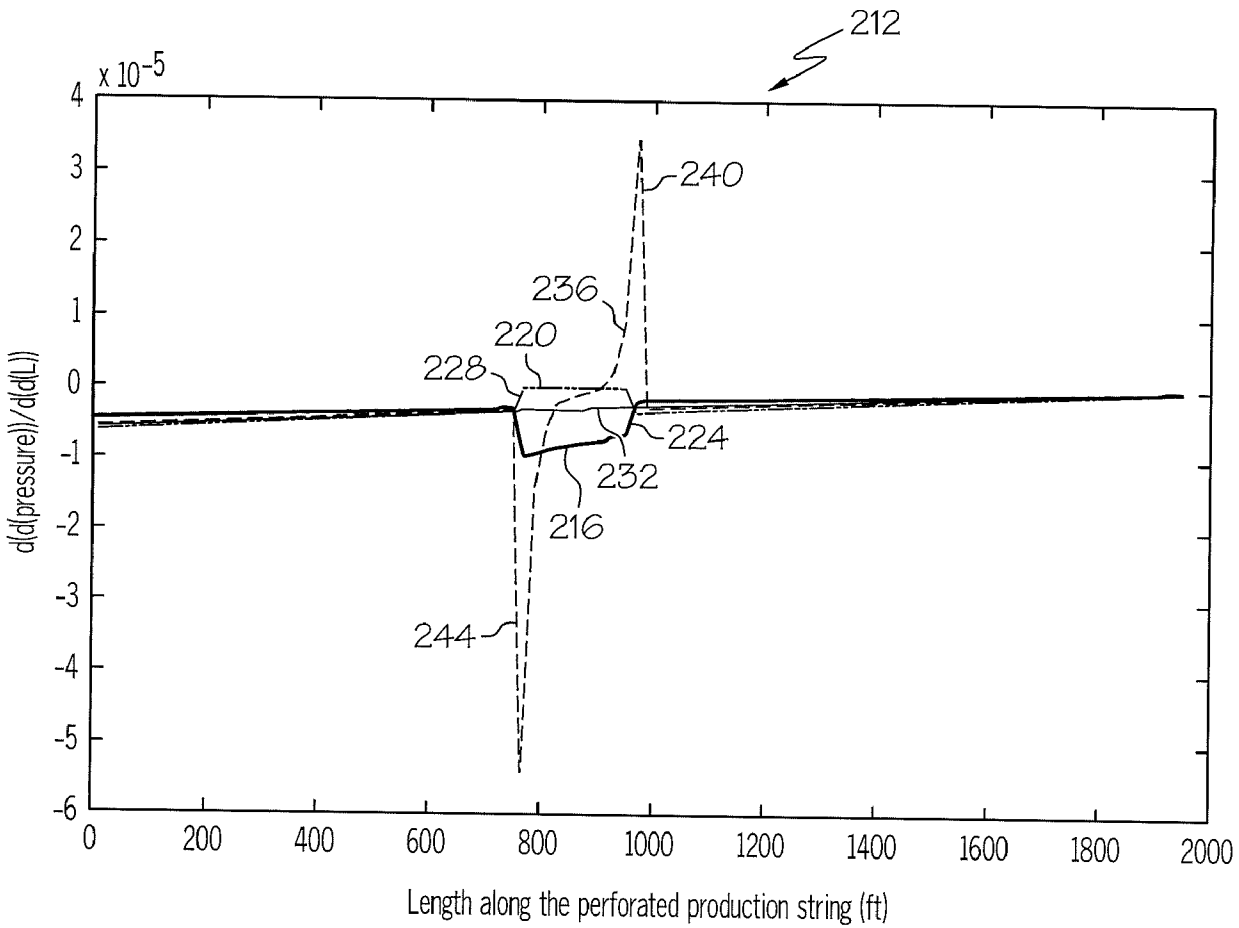
FIG. 5 depicts a graph of the second derivative of the graph of FIG. 2A.

Referring to FIG. 5, a graph 212, of the second derivative of the graph I 110, makes the deviation in gradient of the pressure curves 114, 118, 122, 126 easier to detect than even the curves 182, 186, 190 and 200 of graph 176. Curve 220, for example, which is the second derivative of the curve 122, and curve 216, which is the second derivative of the curve 126, both show offsets 224, 228 in the region 134 that are easier to locate than the deviations in gradient of the first derivative curves 182, 186 in the graph 176. Curve 232, which is the second derivative of the curve 114, in contrast, shows no offset in the region 134, as there is no local disturbance to pressure along the borehole wall 14. Curve 236, of borehole 44, however, includes spikes 240, 244 marking the void ends 138, 139 respectively. The spikes 240, 244 simplify the detection and location of the void 56. These first and second derivatives can be performed in real time with established signal processing techniques. As such, an operator can detect and locate a void, and consequently, a collapse during well operations as soon as they develop, allowing the operator to plan and execute actions to prevent further degradation to well operations that may result from continuing operations at current parameters.

Data and knowledge gathered over time, through usage of embodiments discloses herein, will allow an operator to determine when a change in the region 134 are due to a void, such as the void 56, identified by the curves 196 and 236, as opposed to being due to other changes, such as the changes in formation permeation, as in the curves 182, 186, 216 and 220, for example.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A method of detecting a void in a gravel pack or a collapse in a borehole, comprising:

monitoring pressure along a perforated production string;

taking derivatives of the monitored pressure with respect to length of the perforated production string; and detecting a void in a gravel pack or a collapse in a borehole along the perforated production string based upon changes in pressure gradient along the perforated production string as determined by the derivatives taken.

2. The method of detecting a void in a gravel pack or a collapse in a borehole of claim 1, further comprising attributing a first end of the void or the collapse with a first change in the pressure gradient with the derivatives taken.

3. The method of detecting a void in a gravel sack or a collapse in a borehole of claim 2, further comprising attributing a second end of the void or the collapse with a second change in the pressure gradient with the derivatives taken.

4. The method of detecting a void in a gravel pack or a collapse in a borehole of claim 3, further comprising locating the void or the collapse as being between the first end and the second end.

5. The method of detecting a void in a gravel pack or a collapse in a borehole of claim 3, further comprising identifying conditions conducive to screen erosion at the second end of the void.

6. The method of detecting a void in a gravel pack or a collapse in a borehole of claim 1, wherein the taking derivatives includes signal processing of the monitoring of pressure.

7. The method of detecting a void in a gravel pack or a collapse in a borehole of claim 6, wherein the signal processing includes taking a selected order of derivatives of the monitored pressure with respect to length of the perforated production string.

8. The method of detecting a void in a gravel pack or a collapse in a borehole of claim 1, wherein the taking derivatives of the monitored pressure with respect to length of the perforated production string, highlights locations of the changes in pressure gradient along the perforated production string.

9. The method of detecting a void in a gravel pack or a collapse in a borehole of claim 1, wherein pressure is monitored via a fiber optic cable in the perforated production string.

10. The method of inferring flow in a production string of claim 1, wherein the pressure monitoring includes running fiber optic cable downhole with a sinker.

11. The method of detecting a void in a gravel pack or a collapse in a borehole of claim 1, further comprising identifying conditions conducive to damage to one of the perforated production string and a wall of a borehole within which the perforated production string is located.

12. A method of detecting a void in a gravel pack comprising:

monitoring pressure along a perforated production string;

inferring flow from the monitored pressure;

detecting a void in a gravel pack along the perforated production string based upon changes in pressure gradient along the perforated production string as determined by the monitoring of pressure; and estimating a size including a cross sectional area of the void based on a magnitude of the changes in the pressure gradient.

13. A method of detecting a collapse in a borehole comprising:

monitoring pressure along a perforated production string;

inferring flow from the monitored pressure; and detecting a collapse based upon a plurality of changes in pressure gradient along the perforated production string as determined by the monitoring of pressure.

14. The method of detecting a collapse in a borehole of claim 13, further comprising attributing the plurality of changes in the pressure gradient with at least a first end and a second end of the collapse.

15. The method of detecting a collapse in a borehole of claim 13, further comprising taking first derivatives and second derivatives of pressure versus length along the perforated production string to highlight the changes in the pressure gradient associated with the collapse.

16. A method of predicting a void in a gravel pack or a collapse in a borehole, comprising:

monitoring pressure along a perforated production string within the borehole;

taking derivatives of the monitored pressure with respect to length of the perforated production string; and predicting formation of the void in the gravel pack or the collapse in the borehole based upon matching of the derivatives taken with derivatives taken in a borehole that preceded formation of a void in a gravel pack or a collapse in a borehole of another well.

17. The method of predicting a void in a gravel pack or a collapse in a borehole of claim 16, wherein the taking derivatives includes taking at least one of first derivatives and second derivatives thereof.

* * * * *